US006616545B2

(12) United States Patent
Lacoste

(10) Patent No.: US 6,616,545 B2
(45) Date of Patent: Sep. 9, 2003

(54) GOLF PUTTER SYSTEM

(76) Inventor: Lee A. Lacoste, 4012 Kent Ave., Metairie, LA (US) 70006

( * ) Notice: Subject to any disclaimer, the term of this patent is extended or adjusted under 35 U.S.C. 154(b) by 0 days.

(21) Appl. No.: 10/010,115

(22) Filed: Dec. 6, 2001

(65) Prior Publication Data

US 2003/0114240 A1 Jun. 19, 2003

(51) Int. Cl.[7] ..... A63B 56/06; A63B 53/16

(52) U.S. Cl. ..... 473/248; 473/293; 473/294; 473/295; 473/313; 473/409

(58) Field of Search ..... 473/244, 245, 473/246, 247, 248, 239, 294, 295, 298, 299, 293, 409, 313

(56) References Cited

U.S. PATENT DOCUMENTS

| | | | | | |
|---|---|---|---|---|---|
| 792,631 | A | * | 6/1905 | Taylor | 473/251 |
| 1,616,377 | A | | 2/1927 | Knight | |
| 1,919,221 | A | | 7/1933 | Janes | |
| 2,225,931 | A | * | 12/1940 | Sexton | 473/307 |
| 3,462,155 | A | * | 8/1969 | Pelz | 473/238 |
| 3,663,019 | A | | 5/1972 | Palotsee | |
| 3,963,244 | A | | 6/1976 | Mierzejewski | |
| 4,174,108 | A | * | 11/1979 | Reinholz | 473/247 |
| 4,819,944 | A | | 4/1989 | Doane | |
| 5,037,103 | A | | 8/1991 | Williams et al. | |
| 5,388,834 | A | | 2/1995 | Dawson | |
| 5,401,022 | A | | 3/1995 | McCready | |
| 5,474,300 | A | * | 12/1995 | Scalise et al. | 473/201 |
| 5,511,779 | A | * | 4/1996 | Meyers et al. | 473/246 |
| 5,558,586 | A | * | 9/1996 | Izett et al. | 473/251 |
| 5,669,823 | A | | 9/1997 | McCready | |
| 6,394,911 | B1 | * | 5/2002 | Vaughn | 473/294 |

* cited by examiner

*Primary Examiner*—Stephen Blau
(74) *Attorney, Agent, or Firm*—Joseph T Regard, Ltd

(57) ABSTRACT

A putter including a shaft having first and second ends, the first, lower end pivotally engaging a "T" configured putter head via a spring biased, rotatable hosel, the upper end of the putter having first and second grips pivotally adjustable into a wishbone or other spaced configuration. The configuration of the present system allows each hand to independently engage a separate, spaced grip with the hands engaged with the thumbs gripping the upper portion of each respective handle, as desired by the user. The club is configurable into multiple positions, with the grips and putter head pivotally adjustable so as to allow side putting with the putter head to the side of the user, center putting with the user facing the target croquet style and the putter drawn back between the legs of the user, or pendulum style.

13 Claims, 8 Drawing Sheets

GOLF PUTTER SYSTEM

TECHNICAL FIELD OF THE INVENTION

The present invention relates to golf putters, and in particular to a golf putter having a unique, adjustable configuration to facilitate more accurate putts, and use in a variety of user positions.

The preferred embodiment of the present invention contemplates a putter comprising a shaft having first and second ends, the first, lower end pivotally engaging a "T" configured putter head via a spring biased, rotatable hosel, the upper end of the putter having first and second grips pivotally adjustable into a wishbone or other spaced configuration. Unlike most putter configurations wherein the club is gripped by the palm of the hand with the thumbs down, the present system allows each hand to independently engage a separate, spaced grip with the hands engaged with the thumbs gripping the upper portion of each respective handle, as desired by the user.

The club is configurable into multiple positions, with the grips and putter head pivotally adjustable so as to allow side putts with the putter head to the side of the user, center putting with the user facing the target croquet style, and pendulum style, wherein the putter is drawn back between the legs of the user.

BACKGROUND OF THE INVENTION

The prior art contemplates literally hundreds of diverse alternative golf club configurations, many for putters. Innovations include aiming devices incorporating lasers, lights, or the like, special head configurations, and even dual gripping clubs for adding an element of control in the putting operation. However, most of the clubs are designed for use in the standard putting stance and swing, which may prove a hindrance to some users.

The preferred embodiment of the present invention represents a radical re-design of the putter from the ground up, not only re-configuring the device itself, but also rethinking the traditional method of putting to provide to the user the ultimate tool for striking a ball to urge same to its target destination.

A list of patents which may have some pertinence to the present invention include:

| Patent Number | Inventor | Date of Issue |
|---|---|---|
| 5669823 | McCready | 09/23/1997 |
| 5401022 | McCready | 03/28/1995 |
| 5388834 | Dawson | 02/14/1995 |
| 5037103 | Williams et al | 08/06/1991 |
| 4819944 | Doane | 04/11/1989 |
| 3963244 | Mierzejewski | 06/15/1976 |
| 3663019 | Palotsee | 05/16/1972 |
| 3462155 | Pelz | 08/19/1969 |
| 1919221 | Janes | 07/25/1933 |
| 1616377 | Knight | 02/01/1927 |

U.S. Pat. No. 3,462,155 illustrates longitudinally adjustable club handles emanating laterally from the club, in parallel, horizontal fashion.

U.S. Pat. Nos. 4,819,944, 5,388,834, 1,919,221, and 5,037,103 all teach putters and clubs having two grips situated in parallel fashion centered above the shaft of the club.

U.S. Pat. Nos. 5,401,022 and 5,669,823 teach first and second handles emanating laterally from the shaft of the club in handlebar fashion, the club grips configured to pivot or other wise disconnect for adjustment/storage.

Regarding a rotatable, spring biased head, see U.S. Pat. No. 4,174,108 which teaches an adjustable golf putter wherein the head may be rotatably adjusted relative to the shaft, and held in place via spring bias.

U.S. Pat. Nos. 1,616,377 and 3,663,019 teach clubs having pivotally adjustable shafts to adjust grip and head configuration.

U.S. Pat. No. 3,963,244 is included as an example of a pendulum club, wherein the putter is pivotally connected to a base configured to engage the ground.

GENERAL SUMMARY DISCUSSION OF THE INVENTION

The present invention contemplates a putter system which is easier to learn and implement, more accurate in operation, and more flexible in its use than the prior art systems discussed above.

Unlike the prior art, the present invention provides an extremely diverse golf putter adjustable in almost every conceivable way to provide the ultimate in customization for the needs of each user.

The fully adjustable, wishbone grips provide the user with the ability to adjust the grips in hundreds of possible configurations, not only for providing diverse means of holding and swinging the club, but also to compensate for the size, strength, and special needs of the user.

The present system is also particularly effective for use with handicapped users, who may have partial paralysis or other difficulties in utilizing standard clubs, which can be remedied utilizing the present invention in one of many unique configurations.

The preferred embodiment of the present invention contemplates a putter comprising a shaft having first and second ends, the first, lower end pivotally engaging a "T" configured putter head via a spring biased, rotatable hosel, the upper end of the putter having first and second grips pivotally adjustable into a wishbone or other spaced configuration.

The present system allows each hand to independently engage a separate, spaced grip with the hands engaged with the thumbs gripping the upper portion of each respective handle, as desired by the use, so as to provide enhanced balance and control when compared to prior art putters.

Like the wishbone grips, the putter head is pivotally adjustable so as to allow side putting with the putter head to the side of the user, center putting with the user facing the target croquet style and the putter drawn back between the legs of the user, or pendulum style.

It is therefore an object of the present invention to provide a putter which is adjustable to provide multiple configurations.

It is another object of the present invention to provide a putter having dual grips in an adjustable wishbone configuration to accommodate the needs of the user, while further allowing diversity of the type of swing employed.

It is another object of the present invention to provide a putter and putting technique which facilitates more accurate putts by the user, while allowing a user to capitalize on their strengths and minimize weaknesses in technique.

It is another object of the present invention to provide a putter which allows for side putts, between the leg putts, or frontal putts as desired by the user.

Lastly, it is an object of the present invention to provide a method and system for putting which enhances a user's ability to place a ball at the target utilizing a custom-configurable putting apparatus.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 4C is an exploded view of the pivotal adjustment mechanism and wishbone-configured, dual grips of FIG. 4A.

DETAILED DISCUSSION OF THE INVENTION

Figure 4A:
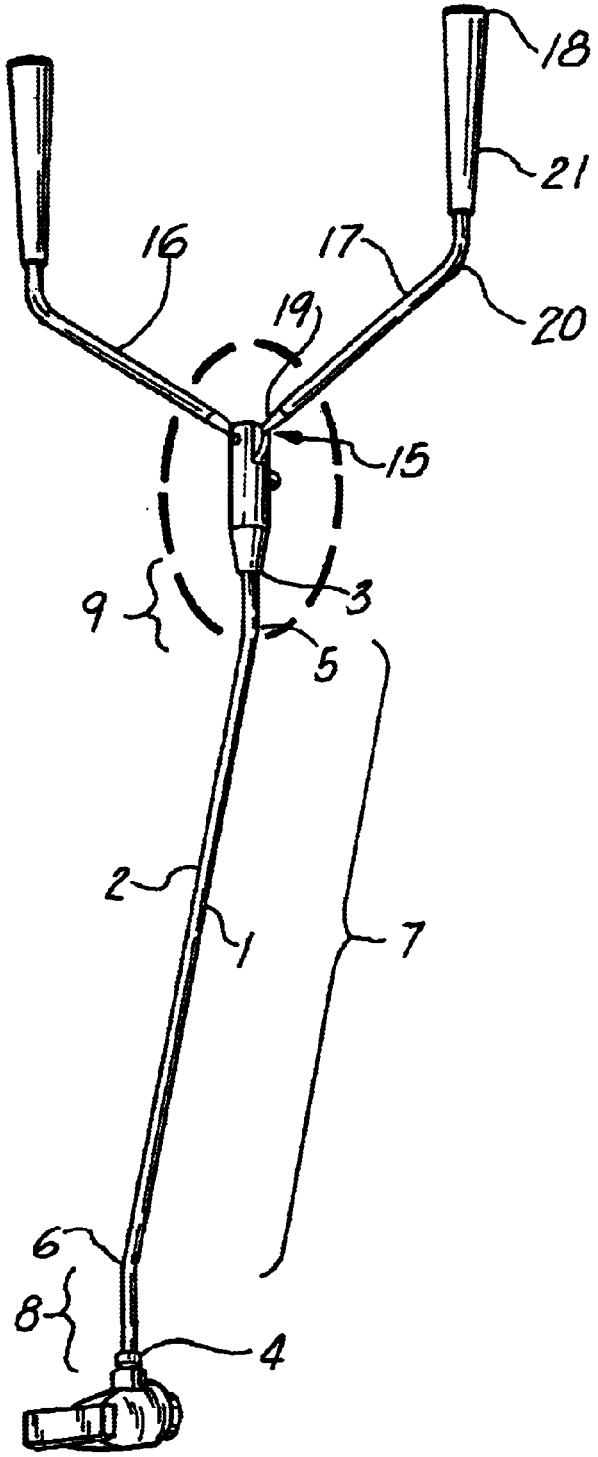
FIG. 4A is an isometric view of the putter of the present invention, illustrating the wishbone configured, pivotally adjustable dual grips and adjustable putter head.
Figure 4B:
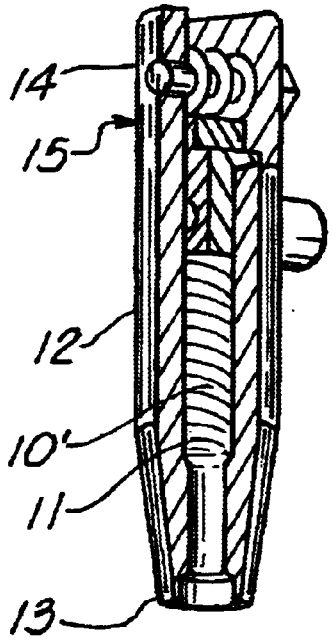
FIG. 4B is a close-up, side, partially cut-away view of the pivotal adjustment mechanism for the wishbone-configured, dual grips of FIG. 4A.
Figure 4D:
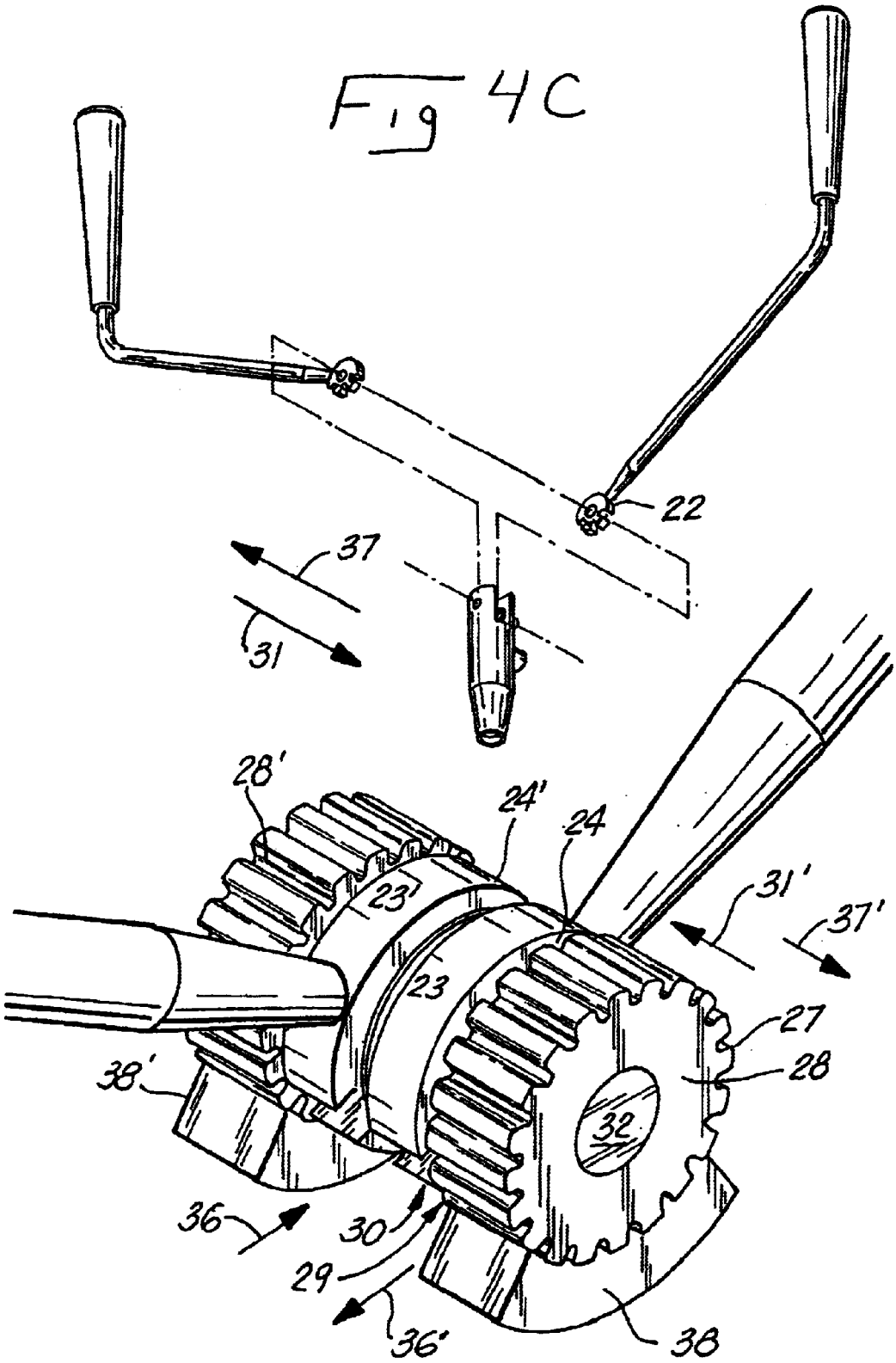
FIG. 4D is a close up of the racheting mechanism associated with the pivotal adjustment mechanism of FIG. 4B.
Figure 4E:
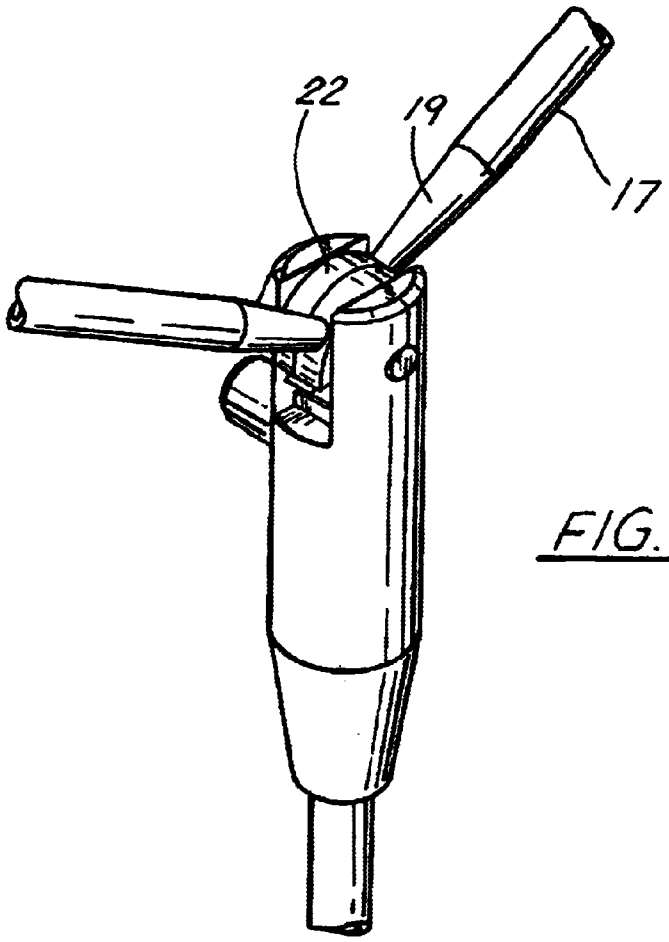
FIG. 4E is an isometric, close-up view of the pivotal adjustment mechanism of FIG. 4C.
Figure 4F:
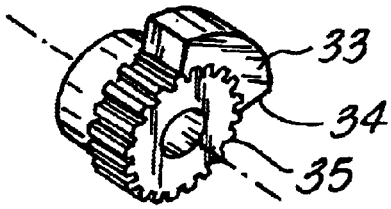
FIG. 4F is a close-up, isometric, partial view of a rachet of the racheting mechanism of FIG. 4D.
Figure 4G:
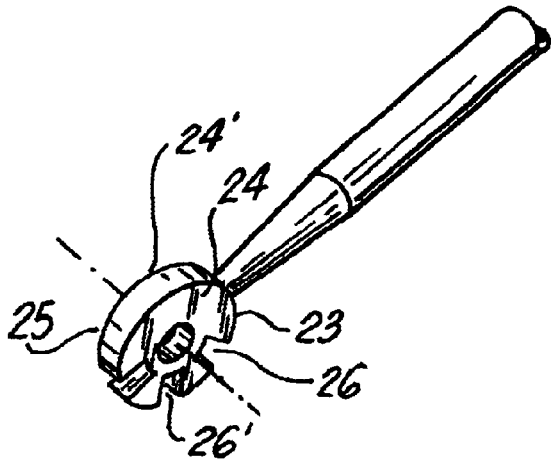
FIG. 4G is a close-up, isometric, view of the end of a grip shaft configured to engage the rachet of FIG. 4F.
Figure 5B:
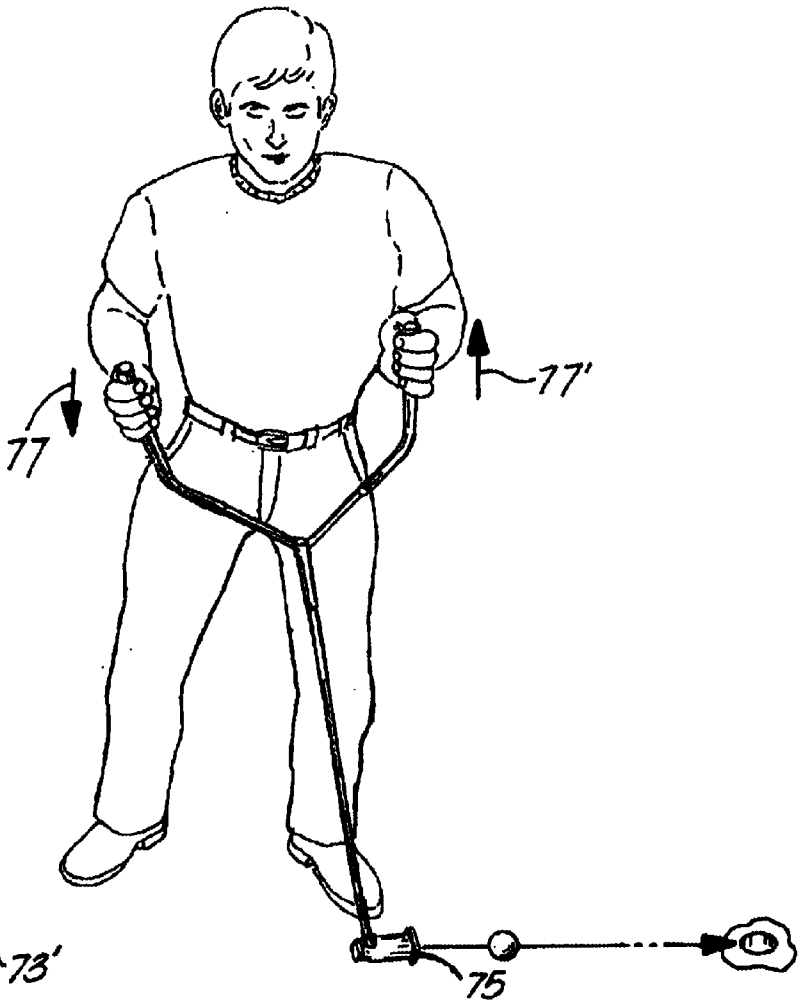
FIG. 5B is a frontal view of a user initiating a forwardly executed putt utilizing the device and method of the present invention.
Figure 5A:
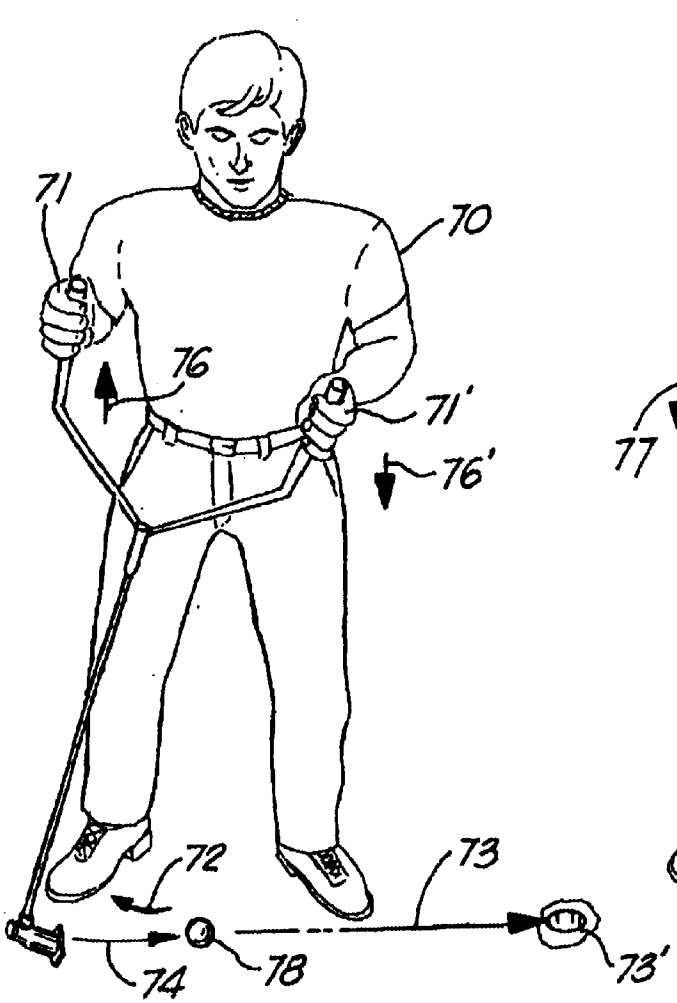
FIG. 5A is a frontal view of a user preparing for the initiation of a forwardly executed putt using the device and method of the present invention.

Referring to FIGS. 4A and 4B, the putter 1 of the present invention comprises a main shaft 2 having first 3 and second 4 ends, the shaft further incorporating first 5 and second 6 bends associated with said first 3 and second 4 ends, defining top 9 and bottom 8 shaft portions having generally aligned orientations, and an angled medial portion 7 associated therebetween.

As shown, a lever bracket 12 is provided having a longitudinal bore 11 therethrough to the first 3 end of the main shaft 3, the lever bracket having first 13 and second 14 ends, the main shaft thus engaging the first 13 end, the second 14 end pivotally engaging first 16 and second 17 grip shafts. Each grip shaft has first 18 and second 19 ends and a medial bend 20 of about forty-five degrees therebetween, the first 18 end having a grip 21 suitable for grasping by the hand of a user, the second 19 end having a pivotal engagement portion 22 preferably comprising a disk 23 having first 24 and second 24' faces, and an outer edge 25 having slots 26, 26' formed therein, as shown in FIGS. 4A–4G.

Continuing with FIGS. 4A–4G, the pivotal adjustment mechanism 15 comprises the pivotal engagement portions 22 of the grip shafts 16, 17, placed in a channel formed in the second end 19 of the lever bracket 12, such that each disk 23, 23' is in communication with a gear cogs 28, 28' form a rachet mechanism 27, wherein cams 38, 38', biased by spring 10' in bore 11, selectively engage 30 their respective gear cogs 28, 28' so as to provide an adjustable pivotal mechanism to maintain the grip shafts in their selected position.

Continuing with the drawings, shaft 32 is configured to engage gear cogs 28, 28' and discs 23, 23' sandwiched thereby, so as to allow the tightening 31, 31' of said gears against disks and facilitate a frictional resistance to pivoting, or loosening 37, 37', for adjustment of the pivotal mechanism. Alternatively, the spring bias provided by spring 10' may be increased or decreased to facilitate lessening of the pressure against cams 38, 38' and their respective gear cogs 28, 28'.

Cams 38, 38' may be threaded 33 in its engagement 34 the teeth of the gear cog to lock 35 same from rotation, which gear could be engaged to disc 24 as discussed above. The teeth may have rounded edges to facilitate adjustment via user's manual positioning of the grip shafts, so that the biased cams provide resistance "clicks" commensurate with the teeth engaging and disengaging their respective gear cogs with the users manual positioning of the grip shafts.

Still other methods of providing adjustable pivoting of the grip shafts, with selective locking 36 or unlocking 36' via slots 26 formed in the disks 24, 24', bores with pins, frictional, or other means of the pivotal members can be realized utilizing ordinary skill, and easily implemented in the present invention with like results.

Continuing with FIG. 4A and FIGS. 8A–8D, the second end 4 of main shaft 2 pivotally connects 52 the head 50 of the club, passing through hosel 51 and pivotally engaging the head via retaining member 53, so as to allow for pivotal adjustment 61 of the club head with regard to the main shaft and grips. Spring bias 54 may be provided to facilitate the retaining of the head 50 in the position desired by the user, and the retaining member 53 may be slotted to facilitate locking of the head in the desired, predetermined position.

The head 50 comprises a body 59 having first 64 and second 64' ends, the first end having a striking member 58 having a striking face 57 to contact a golf ball, the second end 64' may include a weight 55 which can vary in mass and may be threadingly connected 56 to the head for adjustment by the user. The head may be tapered 59 between the hosel and striking member 58.

Figure 1:
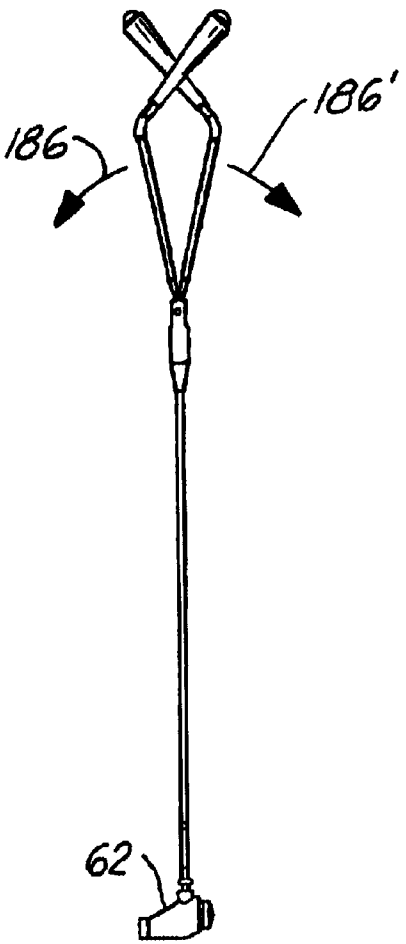
FIG. 1 is a frontal view of the preferred embodiment of the putter of the present invention, illustrating the putter head oriented to the left and the first and second grips oriented with the grips contacting.
Figure 2:
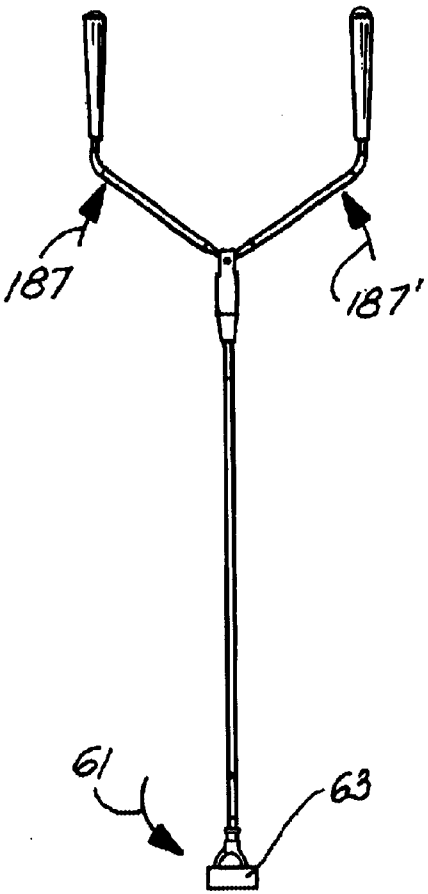
FIG. 2 is a frontal view of the device of FIG. 1, with the grips oriented in a spread, vertical configuration, with the putter head facing forward.
Figure 3:
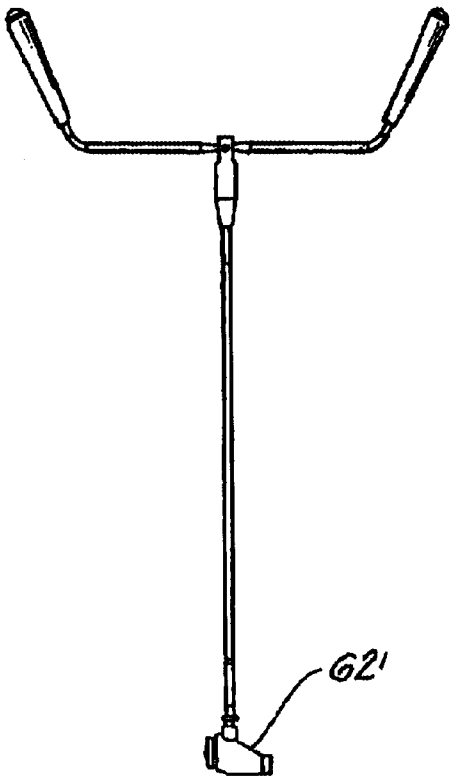
FIG. 3 is a frontal view of the device of FIG. 2, with the grips oriented at a 45 degree angle, with the putter head oriented towards the right.

The pivotal 61 adjustment of the head allows the head to be positioned in first 62 or second 62', side oriented positions or a frontal 63 position as shown in FIGS. 1, 2 & 3; further, the grip shafts may be adjusted to spread 186, 186' the grip portions in opposed orientation to form a wishbone configuration (shown in FIG. 2) or "T" configuration (shown in FIG. 3), or oriented (FIG. 2) towards 187, 187' one another (FIG. 1) for storage, or otherwise pivotally adjusted for configuring the club for use in various putting positions, as will be further detailed below.

Continuing with FIGS. 2, 3, 5A and 5B, in use in a forwardly executed putt, the head of the club is pivotally 61 adjusted so that the striking surface of the club head is aligned toward the ball 78 and the target 73', with the spread grip shafts and club head aligned along a common plane. The user 70 grasps 71, 71' the grip portion 21 of the first 16 and second 17 grip shafts, preferably in a thumbs up position, and positions 72 the club head for a swing by raising 76 the first grip shaft and lowering 76' the second grip shaft. After further aligning 73 the club head, ball 78 and target 73', the user 70 lowers 77 the first grip shaft simultaneously raising 77' the second grip shaft, swinging 74 the club head, and striking 75 the ball, and urging same toward the target, completing the putt.

Figure 6B:
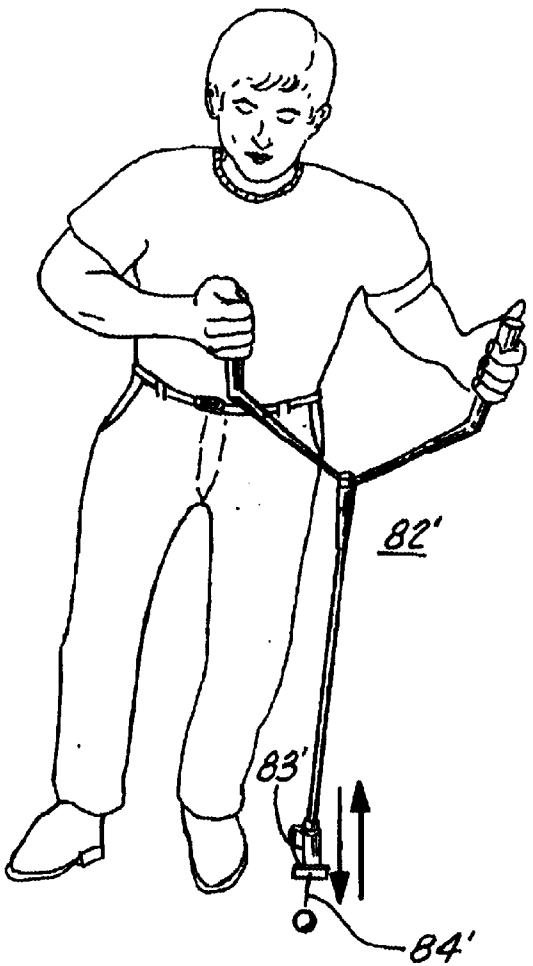
FIG. 6B is a frontal view of a user initiating a putt along the users second side utilizing the device and method of the present invention.
Figure 6A:
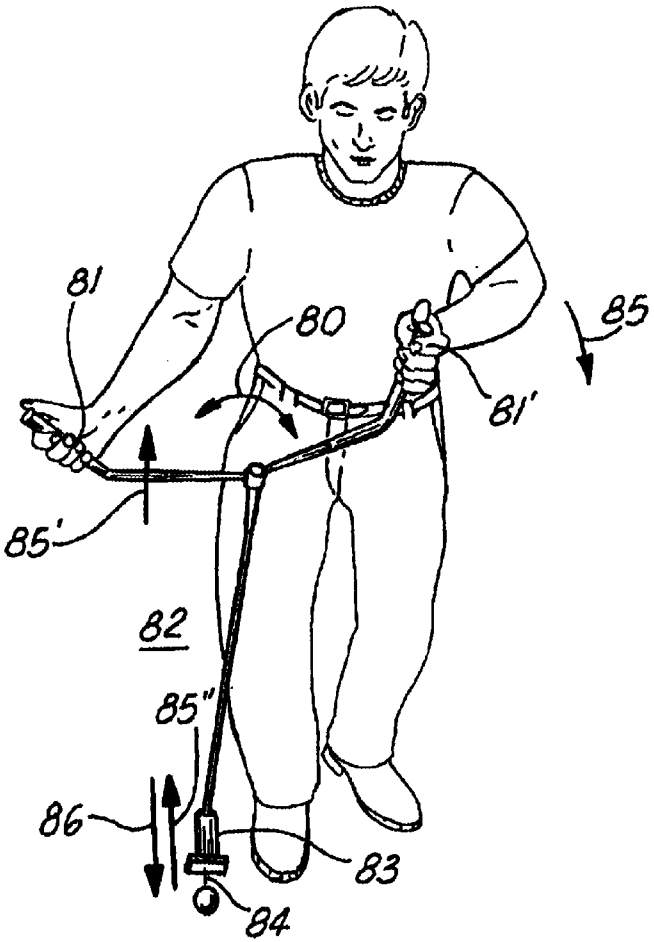
FIG. 6A is a frontal view of a user initiating a putt along the users first side utilizing the device and method of the present invention.
Figure 7:
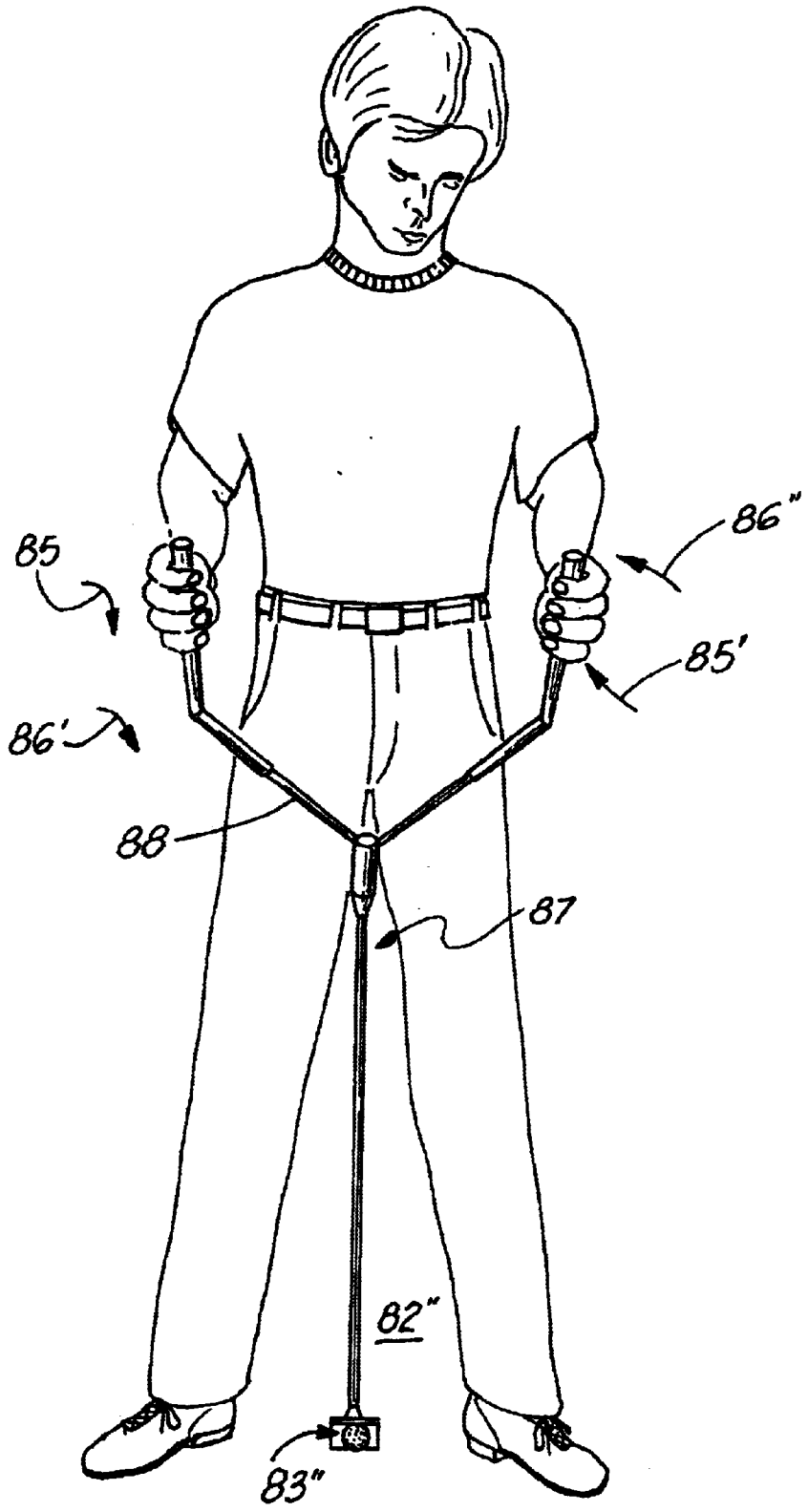
FIG. 7 is a frontal view of a user executing a between-the-legs, croquet-style putt utilizing the device and method of the present invention.
Figure 8C:
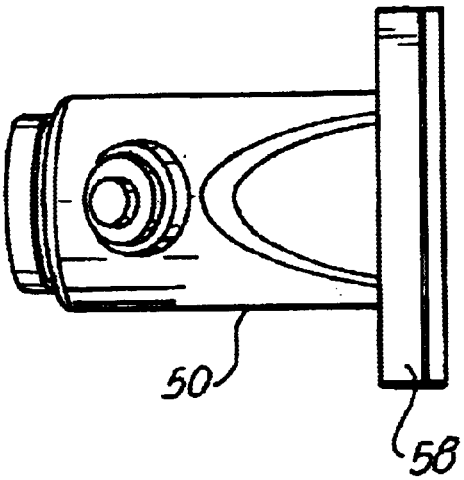
FIG. 8C is a top view of the putter head of the present invention.
Figure 8A:
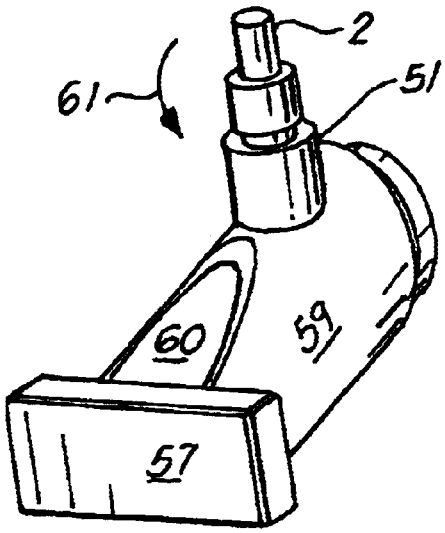
FIG. 8A is an isometric view of the putter head of the present invention.
Figure 8D:
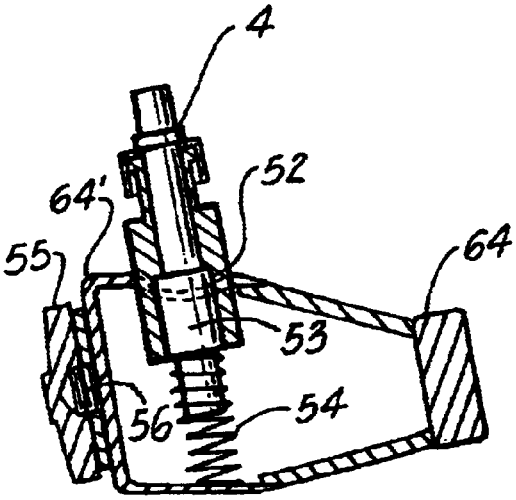
FIG. 8D is a cross-sectional view of the putter head of the present invention.
Figure 8B:
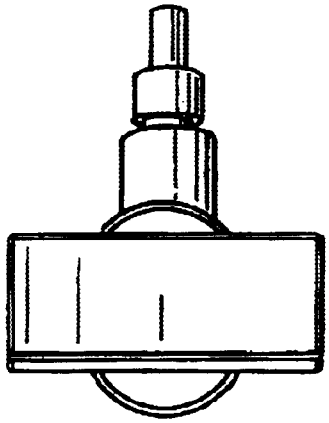
FIG. 8B is a frontal view of the putter head of the present invention.

FIGS. 6A–6B and FIG. 7 illustrate putts from the first 82 (right) or second 82' (left) sides of the user, and a center putt 82" between the legs 87 of the user, respectfully, wherein the user adjusts 80 the grip shafts (shown in a wishbone 88 configuration) to facilitate comfortable grasping 81, 81' of the grips in a comfortable, preferably thumbs-up position, with the club positioned to the preferred side 82, 82' of the user, or between the legs 87 (for a center putt). The club head is shown with the striking surface situated at an orientation which is lateral to a plane aligned with the first and second grip shafts. As shown, in executing a putt, the user aligns 83, 83', 83" the club head striking surface behind the ball and and oriented 84, 84' towards the target.

The user then pivots 85 the upper portions of the grip towards the ball and target, while simultaneously pivoting the lower portion away 85' from the hole and target into 85" the striking position, then pivots 86' the lower portion of the grip towards the ball and target, while simultaneously pivoting 86" the upper portion of the grip away from the hole and target, urging 86 the club head to strike the ball towards the target In summary, the method of putting utilizing the putter of invention could include the steps of, for example:

a. providing a putter, comprising:
   - a main shaft having first and second ends;
   - a putter head pivotally engaged to the second end of said main shaft, said putter head having a striking surface;
   - a lever bracket comprising a body having first and second ends, said first end of said lever bracket affixed to said first end of said main shaft;
   - first and second, opposing grip shafts having first and second ends and a medial area therebetween, said first ends of said first and second grip shafts each pivotally affixed to said second end of said lever bracket so as to facilitate pivotally adjustable positioning of said first and second grip shafts with regard to said main shaft; and
   - first and second grips situated on said second ends of said first and second grip shafts, respectively;

b. grasping with first and second hands said first and second grips, respectively;

c. Pivotally orienting said putter head with regard to the side or the front of the user and adjusting the striking surface of the putter head so that it projects toward the ball;

d. aligning said putter head with the ball and the target, providing an aligned putter head;

e. tilting said first and second grips in a first direction so as to facilitate said putter head being drawing along side of the user and away from the ball and target;

f. while maintaining said aligned putter head, tilting said first and second grips in a second direction so as to facilitate said putter head swinging along the user and striking said ball towards said target.

As earlier indicated, the preferred method of grasping the grips by hand includes keeping the hands in a "thumbs-up" position.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A putter, comprising:

a main shaft having first and second ends;

a putter head pivotally engaged to the second end of said main shaft;

bias engaging said second end of said main shaft means for providing selective pivotal adjustment of said putter head about said main shaft;

a lever bracket comprising a body having first and second ends, said first end of said lever bracket affixed to said first end of said main shaft;

first and second, opposing grip shafts having first and second ends and a medial area therebetween, said first ends of said first and second grip shafts each pivotally affixed to said second end of said lever bracket so as to facilitate pivotally adjustable positioning of said first and second grip shafts with regard to said main shaft; and first and second grips situated on said second ends of said first and second grip shafts, respectively.

2. The putter of claim 1, wherein said putter head further comprises a hosel, and wherein said second end of said main shaft passes through said hosel into said putter head.

3. The putter head of claim 2, wherein said bias means comprises a spring situated with in said putter head, said spring engaging said second end of said main shaft.

4. The putter head of claim 3, wherein said putter head comprises a body having first and second ends, said first end comprising a striking member having a striking face, said second end comprising a weight removably affixed to said body.

5. The putter head of claim 4, wherein said medial portion of said first and second grip shafts comprise a forty-five degree bend to facilitate spreading of said first and second lever grips from said main shaft in a wishbone configuration.

6. The method of putting a ball to a target, comprising the steps of:

a. providing a putter, comprising:
   - a main shaft having first and second ends;
   - a putter head pivotally engaged to the second end of said main shaft, said putter head having a striking surface;
   - a lever bracket comprising a body having first and second ends, said first end of said lever bracket affixed to said first end of said main shaft;
   - first and second, opposing grip shafts having first and second ends and a medial area therebetween, said first ends of said first and second grip shafts each pivotally affixed to said second end of said lever bracket so as to facilitate pivotally adjustable positioning of said first and second grip shafts with regard to said main shaft; and first and second grips situated on said second ends of said first and second grip shafts, respectively;

b. grasping with first and second hands said first and second grips, respectively;

c. pivotally orienting said putter head to the side of the user, and adjusting the striking surface of the putter head so that it projects forward of the user;

d. aligning said putter head with the ball and the target, providing an aligned putter head;

e. tilting said first and second grips in a first direction so as to facilitate said putter head being drawing along side of the user and away from the ball and target;

f. while maintaining said aligned putter head, tilting said first and second grips in a second direction so as to facilitate said putter head swinging along the user and striking said ball towards said target.

7. The method of claim 6, wherein in step "b", said the user grasps said first and second grips with first and second hands oriented in the thumbs-up position.

8. The method of putting a ball to a target, comprising the steps of:

a. providing a putter, comprising:

a main shaft having first and second ends;

a putter head pivotally engaged to the second end of said main shaft, said putter head having a striking surface;

a lever bracket comprising a body having first and second ends, said first end of said lever bracket affixed to said first end of said main shaft;

first and second, opposing grip shafts having first and second ends and a medial area therebetween, said first ends of said first and second grip shafts each pivotally affixed to said second end of said lever bracket so as to facilitate pivotally adjustable positioning of said first and second grip shafts with regard to said main shaft; and first and second grips situated on said second ends of said first and second grip shafts, respectively;

b. grasping with first and second hands said first and second grips, respectively;

c. orienting said putter head between the legs of the user, and adjusting the striking surface of the putter head so that it projects forward of the user;

d. aligning said putter head with the ball and the target, providing an aligned putter head;

e. tilting said first and second grips in a first direction so as to facilitate said putter head being drawn further between the legs of the user and away from the ball and target;

f. while maintaining said aligned putter head, tilting said first and second grips in a second direction so as to facilitate said putter head swinging from between the legs of the user and striking said ball towards said target.

9. The method of claim 8, wherein in step "b", said the user grasps said first and second grips with first and second hands oriented in the thumbs-up position.

10. The method of putting a ball to a target, comprising the steps of:

a. providing a putter, comprising:

a main shaft having first and second ends;

a putter head pivotally engaged to the second end of said main shaft, said putter head having a striking surface;

a lever bracket comprising a body having first and second ends, said first end of said lever bracket affixed to said first end of said main shaft;

first and second, opposing grip shafts having first and second ends and a medial area therebetween, said first ends of said first and second grip shafts each pivotally affixed to said second end of said lever bracket so as to facilitate pivotally adjustable positioning of said first and second grip shafts with regard to said main shaft; and first and second grips situated on said second ends of said first and second grip shafts, respectively;

b. grasping with first and second hands said first and second grips, respectively;

c. positioning said putter in front of the user, and adjusting the striking surface of the putter head so that it projects forward of the user;

d. aligning said putter head with the ball and the target, providing an aligned putter head;

e. tilting said first and second grips in a first direction so as to facilitate said putter head being drawn toward the user and away from the ball and target;

f. while maintaining said aligned putter head, tilting said first and second grips in a second direction so as to facilitate said putter head swinging away from the user and striking said ball towards said target.

11. The method of claim 10, wherein in step "b", said the user grasps said first and second grips with first and second hands oriented in the thumbs-up position.

12. The method of putting a ball to a target, comprising the steps of:

a. providing a putter, comprising:

a main shaft having first and second ends;

a putter head pivotally engaged to the second end of said main shaft, said putter head having a striking surface;

a lever bracket comprising a body having first and second ends, said first end of said lever bracket affixed to said first end of said main shaft;

first and second, opposing grip shafts having first and second ends and a medial area therebetween, said first ends of said first and second grip shafts each pivotally affixed to said second end of said lever bracket so as to facilitate pivotally adjustable positioning of said first and second grip shafts with regard to said main shaft; and first and second grips situated on said second ends of said first and second grip shafts, respectively;

b. grasping with first and second hands said first and second grips such that said user's hands are oriented in a thumbs-up position about each grip, and wherein said first and second grips are oriented in a generally vertical position, respectively;

c. orienting said putter in front of the user, and pivotally adjusting the putter head striking surface so that it is oriented towards a side of the user;

d. aligning said putter head with the ball and the target, providing an aligned putter head;

e. tilting said first and second grips in a first direction so as to facilitate said putter head being drawing along side of the user and away from the ball and target;

f. while maintaining said aligned putter head, tilting said first and second grips in a second direction so as to facilitate said putter head swinging along the user and striking said ball towards said target.

13. The method of claim 12, wherein in step "b", the palms of the user's hands are oriented generally toward one another, and the user's thumbs are situated adjacent to the end of each grip distal said putter head.

* * * * *